US005214899A

United States Patent [19]

Beeche et al.

[11] Patent Number: 5,214,899

[45] Date of Patent: Jun. 1, 1993

[54] MODULAR TRUSS FRAME SYSTEM

[76] Inventors: Gregory L. Beeche, 65 Smith Rd., Mechanicville, N.Y. 12118; Roy T. Scrafford, 151 Willow La., Scotia, N.Y. 12302

[21] Appl. No.: 710,026

[22] Filed: Jun. 3, 1991

Related U.S. Application Data

[63] Continuation-in-part of Ser. No. 362,143, Jun. 5, 1989, abandoned.

[51] Int. Cl.[5] ..... E04H 12/10; E04C 2/08

[52] U.S. Cl. ..... 52/648.1; 403/169

[58] Field of Search ..... 403/169-172; 52/645-648

[56] References Cited

U.S. PATENT DOCUMENTS

| | | | |
|---|---|---|---|
| 2,682,322 | 6/1954 | Bloedow | 403/345 |
| 3,421,280 | 1/1969 | Attwood et al. | 52/648 |
| 3,861,107 | 1/1975 | Papayoti | 403/171 |
| 4,015,390 | 4/1977 | Howorth | 52/235 |
| 4,070,847 | 6/1978 | Madl | 403/171 |
| 4,583,359 | 4/1986 | Staeger | 52/738 |
| 4,805,368 | 2/1989 | Wesselski | 52/648 |

FOREIGN PATENT DOCUMENTS

| | | | |
|---|---|---|---|
| 2904330 | 8/1979 | Fed. Rep. of Germany | 403/171 |
| 1186627 | 4/1970 | United Kingdom | 403/169 |

*Primary Examiner*—James L. Ridgill, Jr.
*Attorney, Agent, or Firm*—Robert J. Jarvis

[57] ABSTRACT

A modular truss frame system which can be assembled in a variety of sizes and configurations includes a plurality of interchangeable tubular chord members, as well as a plurality of interchangeable tubular diagonal web members. A plurality of top node connection members join together predetermined ones of the top chord members in an end-to-end relationship. The top node members also serve to join one end of each of the web members to the ends of predetermined ones of the top chord members. A plurality of bottom node connection members are used to join together predetermined ones of the ends of the web members which are opposite the ends thereof that are joined to the top chord members by the associated top node members. The top chord members and the associated ends of the web members are connected to the top node, and the opposite ends of the web members are connected to the bottom node, by means such that each member is attachable to its respective node without rotational movement of the member. In the assembled truss frame system, the web members form truss-like braces for the top chord members. For applications where further torsional rigidity is desired, predetermined ones of the bottom nodes may be connected together by one or more bottom chord members.

24 Claims, 9 Drawing Sheets

MODULAR TRUSS FRAME SYSTEM

RELATED APPLICATION

This application is a continuation-in-part of application Ser. No. 362,143, filed Jun. 5, 1989 by the inventors herein now abandoned.

FIELD OF THE INVENTION

This invention relates to truss frame assemblies which may be used as building components in forming floors, roofs, and walls, or as scaffolding systems for building construction and maintenance. More particularly, it relates to a system of modular components which may be assembled to provide truss frames which are light in weight and which can be readily adapted to a variety of sizes and configurations, while at the same time exhibiting very high span strength.

BACKGROUND OF THE INVENTION

There are many applications in the building industry where a portable, easy to assemble and disassemble frame assembly is desirable. Some examples are temporary floors, walls, and roofs, and the scaffolding systems employed to perform construction and maintenance tasks on various portions of buildings and other structures. Particularly in the scaffolding area, frame assemblies which have been employed in the past have typically been constructed so that the task involved could be performed on one portion of the building at a time. The constructed scaffolding frequently was not moveable from one portion of the building to another, but rather required disassembly before being moved and reassembly after being moved to another portion of the building. Furthermore, the scaffolding systems employed were constructed in such a manner that a considerable amount of time and energy were required to dismantle and then reassemble the platform each time it was moved. Other problems with prior art scaffolding systems were the safety risks involved in constructing and using the previous scaffolding systems, as well as the inability to change the level of most of these prior art work platforms without dismantling a substantial portion of the scaffolding.

Recently, a number of scaffolding system improvements have been made which are aimed at alleviating many of the problems noted above. U.S. Pat. No. 4,234,055, issued to G. L. Beeche on Nov. 18, 1980, describes a mobile suspension scaffold which requires assembly and dismantling only once for each construction site, at the beginning and the end of the job, respectively. The system described may be moved along the sides of a building and around building corners without being disassembled. A suspended scaffold system which may be used either independently or in conjunction with this mobile scaffold is the folding scaffold described in U.S. Pat. No. 4,253,548, issued to G. L. Beeche on Mar. 3, 1981. The system disclosed includes a plurality of work platforms which are foldably linked together.

Another problem that has been encountered in modern building construction and maintenance is the variety and complexity of the building shapes and structures being constructed. Designing and constructing customized scaffolding systems to fit particular building shapes and to accommodate particular tasks can be both time-consuming and relatively expensive. Contemporary scaffolding systems are required to be adaptable to a variety of configurations and applications. The constructed scaffolds must also have sufficient span strength and torsional rigidity to safely hold both the workers using the scaffolding and their materials.

These latter problems are addressed in co-pending U.S. application Ser. Nos. 861,133 and 048,108, filed May 8, 1986 and May 7, 1987, respectively, both filed in the name of G. L. Beeche, one of the inventors herein. The first of these two applications discloses a scaffolding system which employs modular components which may be combined to provide a variety of scaffold configurations and sizes. The latter application provides a scaffolding platform which may be used either independently of or in conjunction with the modular scaffolding system disclosed in application Ser. No. 861,133. The scaffold platform disclosed in application Ser. No. 048,108 is itself modular in nature, so that a variety of platform sizes and configurations may be provided.

The modular platform described in application Ser. No. 048,108 utilizes a truss frame component which is effectively braced in three dimensions. Such a configuration provides high resistance to structural deformation caused by externally applied loads, and allows an assembly of such truss frames to be employed as a truss beam for spanning long distances. The present invention provides a system of modular components which may be utilized to efficiently and economically form the type of truss frames and assemblies disclosed in application Ser. No. 048,108. In addition, the components of the system developed by the present inventors are uniquely designed to provide the truss frame assembly with a number of novel characteristics. Truss frame assemblies formed using the modular components of the present invention have application beyond the area of scaffolding systems. For example, lightweight structures having high span strength can be fabricated which are useful as concert staging, curtain walls, and floor and ceiling structures.

Accordingly, it is an object of the present invention to provide a modular truss frame system which is usable in a wide variety of applications.

It is a further object of the present invention to provide a modular truss frame system which utilizes a limited number of interchangeable components to form frame assemblies of various sizes and configurations.

It is another object of the present invention to provide a truss frame system for which assemblies of the truss frame components exhibit very high span strength and torsional rigidity, while at the same time being relatively light in weight.

It is also an object of the present invention to provide truss frame assemblies which can accommodate a variety of accessory attachments.

SUMMARY OF THE INVENTION

In accordance with the present invention, a modular truss frame system comprises a plurality of interchangeable tubular top chord members, a plurality of interchangeable tubular diagonal web members, and a plurality of top and bottom node connection members. The top node members join predetermined ones of the top chord members together in an end-to-end relationship. The top nodes also join one end of each of the web members to the ends of predetermined ones of the top chord members. The bottom node connection members join together predetermined ones of the ends of the web members which are opposite the ends thereof that are joined to the top chord members by the top node members. The system also includes means for attaching the top chord members and the web members to the top node, and the web members to the bottom node, in such a manner that the members are attachable to their respective node members without rotational movement of the members. In the resulting assembly, the web members form truss-like braces for the top chord members.

The truss frame system may also include a plurality of bottom chord members which join together predetermined ones of the bottom nodes. The top and bottom nodes, and the top and bottom chord members, may be identical with each other. The truss frame system may further include a plurality of supplementary support members which are attachable to the top chord members.

BRIEF DESCRIPTION OF THE DRAWINGS

The subject matter which is regarded as the invention is particularly pointed out and distinctly claimed in the concluding portion of the specification. The invention itself, however, both as to its organization and its method of practice, together with further objects and advantages thereof, may best be understood by reference to the following description taken in conjunction with the accompanying drawings, in which:

DETAILED DESCRIPTION OF THE PREFERRED EMBODIMENTS

Figure 1:
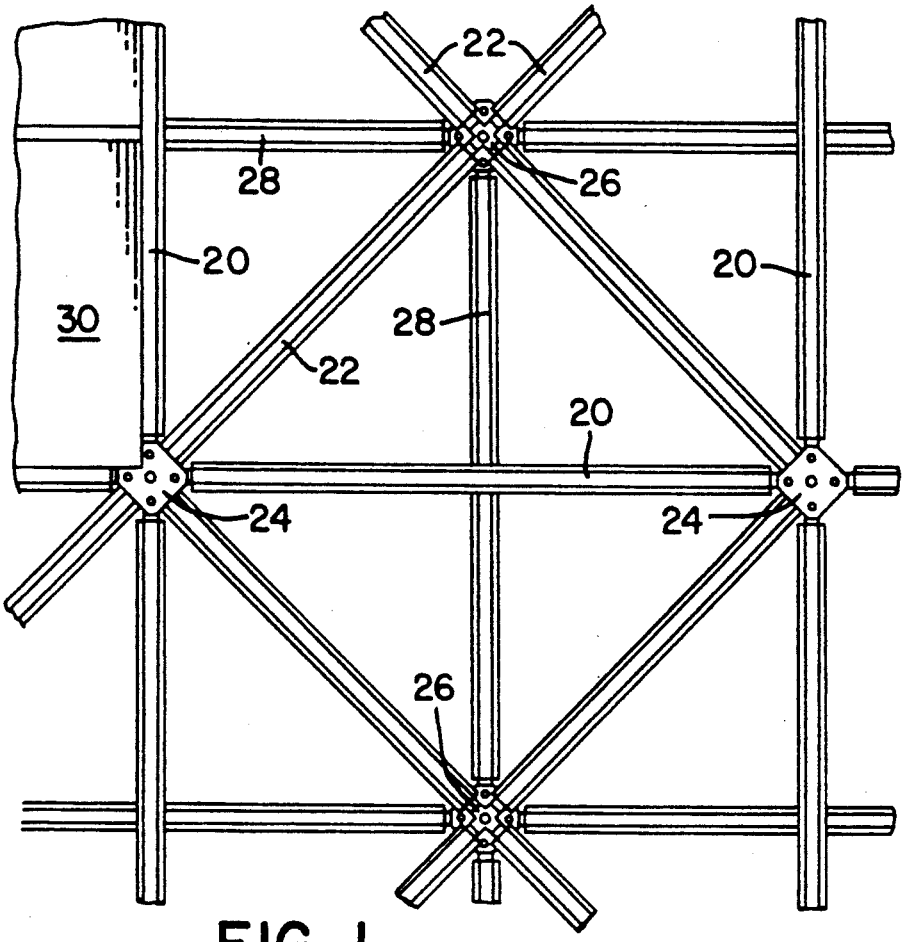
FIG. 1 is a plan view schematically illustrating a portion of one embodiment of a truss frame assembly, in accordance with the modular concept of the present invention.

FIG. 1 schematically illustrates one embodiment of a modular truss frame system in accordance with the present invention. The truss frame system shown therein comprises a plurality of interchangeable tubular top chord members 20, along with a plurality of similarly interchangeable tubular diagonal web members 22. The system includes a plurality of top node connection members 24 which join top chord members 20 together in an end-to-end relationship. Top nodes 24 also join one end of each of web members 22 to the ends of top chords 20. A plurality of bottom node connection members 26 are employed to join together the ends of web members 22 which are opposite the ends thereof that are joined to top chords 20 via top nodes 24.

Figure 2:
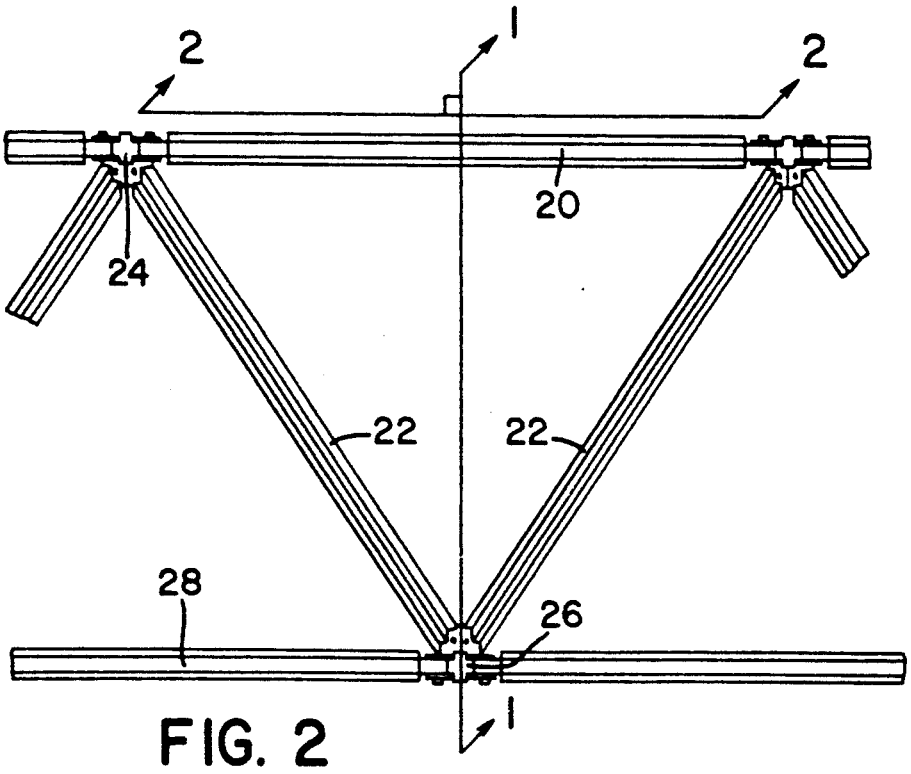
FIG. 2 is a side-elevational view of the truss frame assembly shown in FIG. 1.

As is better illustrated in FIG. 2, top chords 20 and top nodes 24 are further disposed so that, when top chords 20 are joined together, they form a continuous chord line in a direction parallel to that spanned by the connected chords, which direction is designated in FIG. 2 by plane 2—2. In the embodiment shown in FIG. 1, top chords 20 are also arranged so as to form the shape of a series of interconnected squares. However, rather than using four chords together to form a square, three chords could be arranged in the shape of a triangle. Four chords are preferred because such an arrangement provides coverage for a larger area using less components than for a system using triangularly shaped truss frames.

In the preferred arrangement illustrated in FIG. 1, web members 22 are further configured with respect to top chords 20 so as to be symmetrically disposed about a plane which is taken through the center of the particular bottom node which joins together web members 22 associated with a particular truss frame. As is shown in FIG. 2 by plane 1—1, that plane is substantially perpendicular to plane 2-2 containing top chords 20. When web members 22 are so disposed, top chords 20, web members 22, and top and bottom nodes 24 and 26 conveniently form the shape of a series of interconnected inverted pyramids.

For applications where it is desirable to have three-dimensional bracing in all directions, the truss frame system of the present invention may further comprise a plurality of interchangeable tubular bottom chord members 28 which are employed to join together predetermined ones of bottom nodes 26. Again, as better illustrated in FIG. 2, bottom chords 28 and bottom nodes 26 are preferably further disposed so that, when bottom nodes 26 are joined together by bottom chords 28, bottom chords 28 form a continuous chord line in the direction parallel to that spanned by the connected chords, i.e., in the direction parallel to plane 2—2. As is illustrated by FIG. 1, these chord lines may run in either direction in the two-dimensional plane.

When the truss frame assembly is used as a scaffold, decking 30 may be placed over the top of chords 20. However, it should be noted that the truss frame assembly of this invention is not limited in application to scaffolding platforms. Furthermore, because of the interaction between the length of top chords 20 and web members 22, and the effect of the relationship between the two on the assembly's span strength, rigidity, and weight, just a few different length standard parts for chords 20 and members 22 results in a large variety of system capabilities. As will be explained hereinbelow in relation to FIG. 4, the truss frame assembly of the present invention allows for the use of different length diagonal members, for a particular length of chord members, in such a manner that the resulting angle between the diagonal and chord members provides for the transmission of forces through the corresponding members in directions which all intersect at the center of the node. Also, although not shown in the Figures, besides the four top chords 20 which are arranged in a square, additional top chords could be added between top nodes 24 in a diagonal fashion, being attached to nodes 24 by means of openings 52 as further explained below.

The inventive truss frame system also includes means for attaching top chords 20 and web members 22 to top nodes 24, and web members 22 to bottom nodes 26. The attaching means is disposed so that these members are attachable to their respective nodes without rotational movement of the members. The attaching means and the top node connection member are further configured in the frame assembly of the present invention so that the top chord member is restrained from movement with respect to the top node connection member, in directions other than those lying in plane 2—2 which contains the top chord members. In this manner, the node connection member is prevented from rotational movement in directions which intersect plane 2—2. In a similar fashion, the diagonal members are restrained from bending movement with respect to the top node connection member in directions which are parallel to plane 2—2 containing the top chord members. For the orientation shown in FIG. 2, the top chord members are restrained from movement in a vertical direction, and the diagonal members are restrained from movement in a horizontal direction. The combination of these two restraints results in a frame assembly which has excellent resistance to rotational forces which would otherwise distort the assembly.

Figure 3:
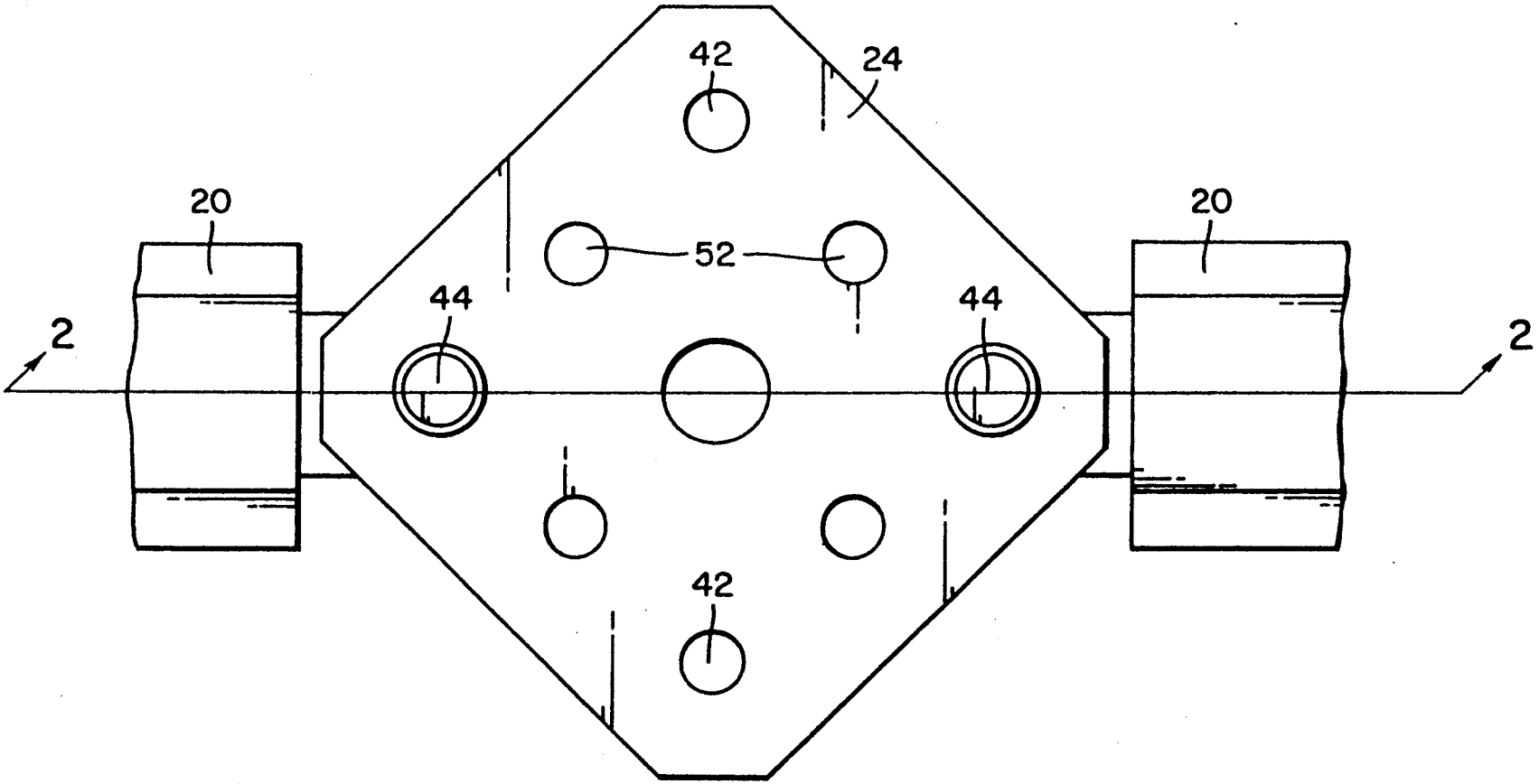
FIG. 3 is a plan view schematically illustrating one embodiment of a top node connection in accordance with the present invention, in which view the diagonal web members which would ordinarily be attached thereto have been removed for the sake of clarity.
Figure 4:
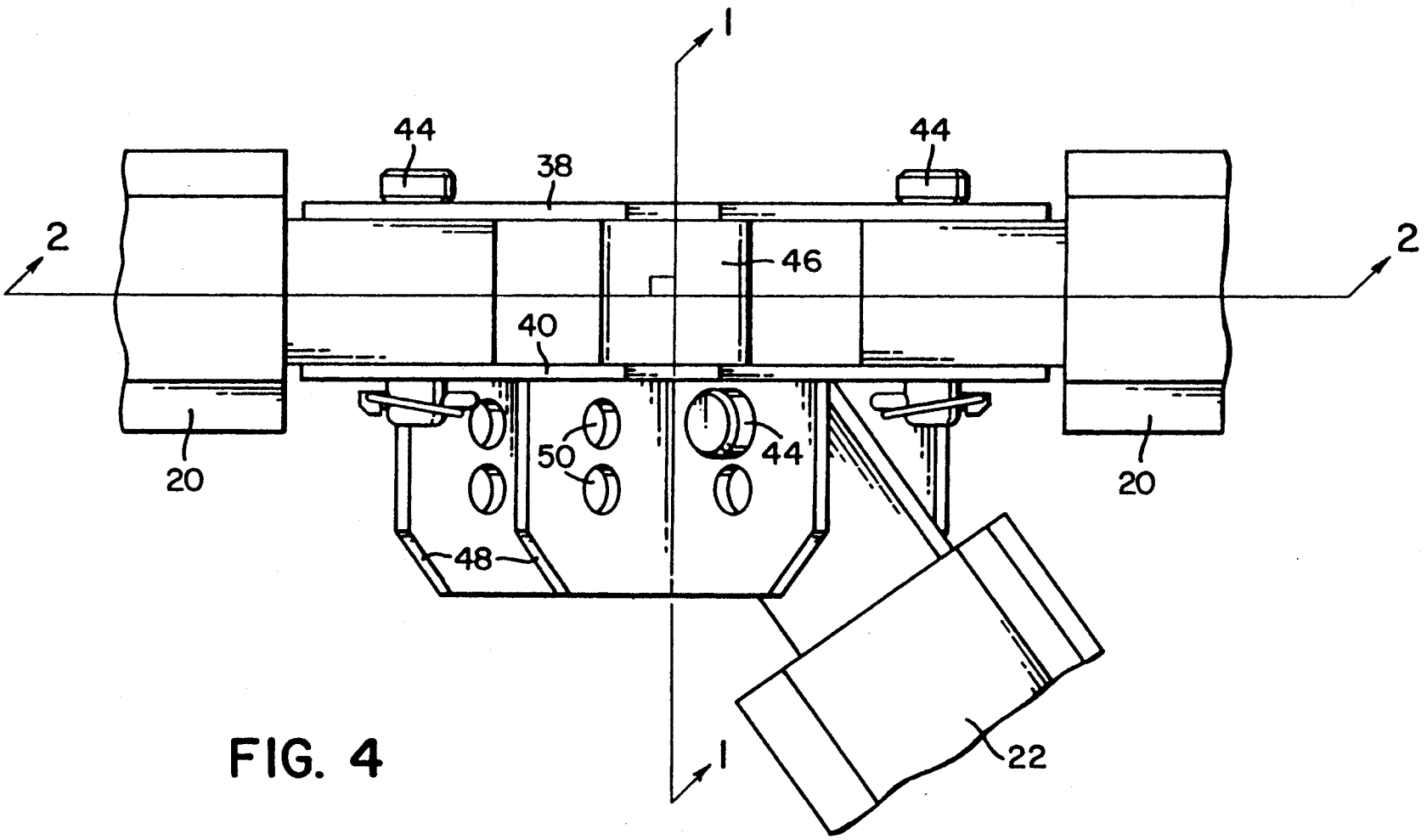
FIG. 4 is a side-elevational view of the node connection shown in FIG. 3, in which view only one diagonal web member is shown, again for the sake of clarity.
Figure 6A:
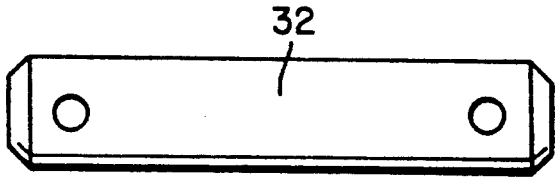
FIGS. 6(*a*) and 6(*b*) are side-elevational, exploded views of a fastener which is particularly useful for connecting the modular components of the present system together.
Figure 6B:
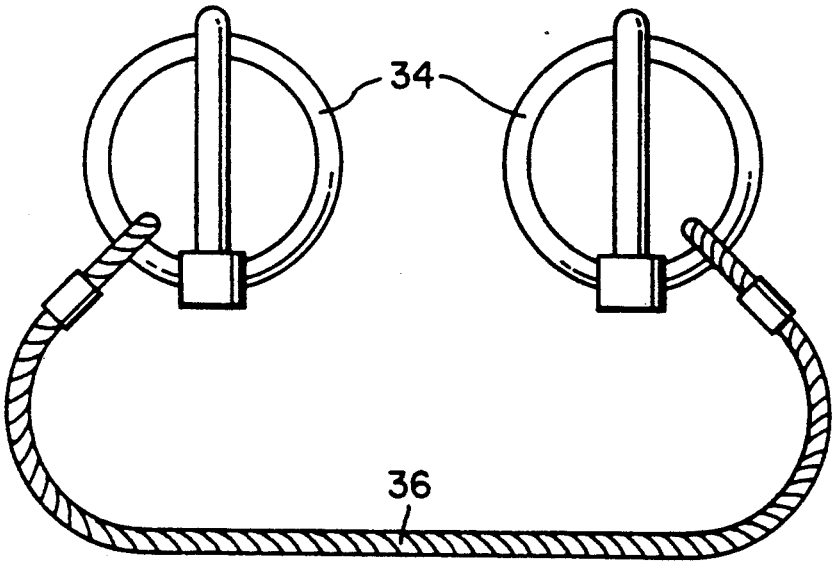

As illustrated in FIGS. 3 and 4, in one embodiment the attaching means comprises openings defined in the node members and corresponding openings defined in the associated ends of the chord members. The two sets of openings are aligned so that a fastener is disposable through the aligned openings in order to secure the components in position. The fastener may be either a bolt and nut arrangement or a pin with a retaining clip. Particularly when top chords 20, bottom chords 28, and web members 22 are identical in cross section, and top and bottom nodes 24 and 26 are also identical, it is helpful to have the fastening pins be of uniform size and be of the configuration shown in FIG. 6(*a*). In that configuration, pin 32 can be inserted from either direction, and is retained from movement at each end by lynch pins 34 which are connected to each other by lanyard 36, in order to prevent unintended loss of one of the pins, all as shown in FIG. 6(*b*).

Figure 5:
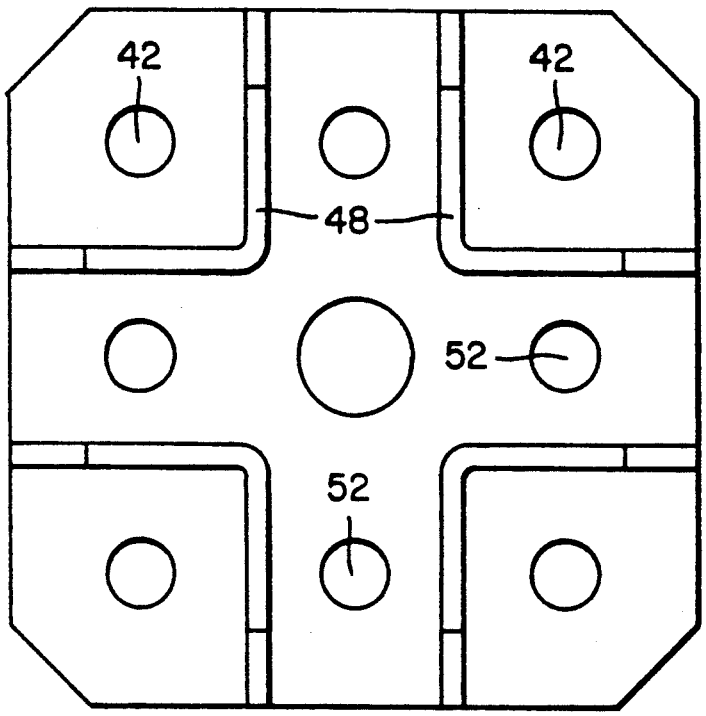
FIG. 5 is a bottom view of the node connection shown in FIG. 3, as it would appear without any chord or diagonal web members attached thereto.

The node shown in FIGS. 3-5 comprises first and second parallel plate members 38 and 40. Plates 38 and 40 each has defined therein a plurality of connection openings 42 defined through plates 38 and 40. The longitudinal axis of each opening 42 is in a direction which is substantially perpendicular to plane 2—2 containing parallel plate members 38 and 40. Openings 42 are further disposed for alignment with corresponding openings in top and bottom chords 20 and 28. Fastener pin 44 is disposed through openings 42 in order to secure the node and the chord members together. Plates 38 and 40 are further disposed so that, when top chord 20 is connected therebetween, it is substantially restrained from bending movement with respect to the node member, in directions which intersect plane 2—2 of parallel plate members 38 and 40.

The inventive node includes spacer 46 disposed between first and second plate members 38 and 40, with the respective ends of spacer 46 being attached to plates 38 and 40. The node illustrated in FIG. 4 also includes a plurality of tab members 48 which are attached to plate member 40 on the face thereof that is opposite the face of plate 40 which is attached to spacer 46. Tabs 48 extend generally perpendicularly away from the plane of plate member 40, i.e., orthogonal to plane 2—2. Each tab 48 has at least one connection opening 50 defined therethrough. The longitudinal axis of each opening 50 is in a direction which is generally parallel to plane 2—2 of plate member 40. Openings 50 are further disposed for alignment with corresponding openings in web members 22, so that fasteners 44 can be disposed through openings 50 in order to connect web members 22 to the node.

The location of openings 50 is further chosen so that they are in line with the center of the node with respect to the direction in which force is transmitted through member 22. Depending upon the lengths chosen for chords 20 and diagonals 22, one or the other of openings 50 will be the correct location to ensure that forces through diagonal 22 are transmitted in a direction which intersects the center of the node. The center of the node is also in line with the direction in which force is transmitted through chords 20. Tabs 48 are further disposed so as to restrain diagonals 22 from bending movement with respect to the node member, in directions which are parallel to plane 2—2 of plate 40, again for the purpose of providing the frame assembly with rotational stiffness. Hence, for the node embodiment of FIG. 4, plates 38 and 40 prevent top chords 20 from bending rotation movement in the vertical direction. At the same time, diagonal members 22 are restrained from bending rotation in the horizontal plane about the longitudinal axis of spacer 46. In this manner, the node simultaneously provides the truss frame assembly with resistance to bending movement in both directions. The result is a high strength assembly which exhibits the rotational stiffness required to provide a high span strength platform capable of supporting relatively high loads.

For the node illustrated in FIG. 4, spacer 46 conveniently comprises a hollow cylinder disposed so that its longitudinal axis is perpendicular to plane 2—2 containing plates 38 and 40. Furthermore, plates 38 and 40 may include at least one set of aligned openings 52 defined therethrough for attachment of external apparatus to the node. Alternatively, for applications where additional strength is desired, openings 52 may be employed to connect additional top chord members to the frame assembly, either by connecting additional top chords 20 in a diagonal fashion, or by replacing chord 20 which is connected via opening 42 with two like chords 20 each of which is attached via opening 52.

When spacer 46 is a hollow cylinder, the opening therethrough provides an ideal location for either supporting the truss frame assembly or for suspending heavy loads therefrom. Because the longitudinal axis of spacer 46 is co-located with the center of the node connection, the forces produced by these loads are transferred along the members of the frame assembly and therefore do not produce any rotational thrust.

Figure 7:
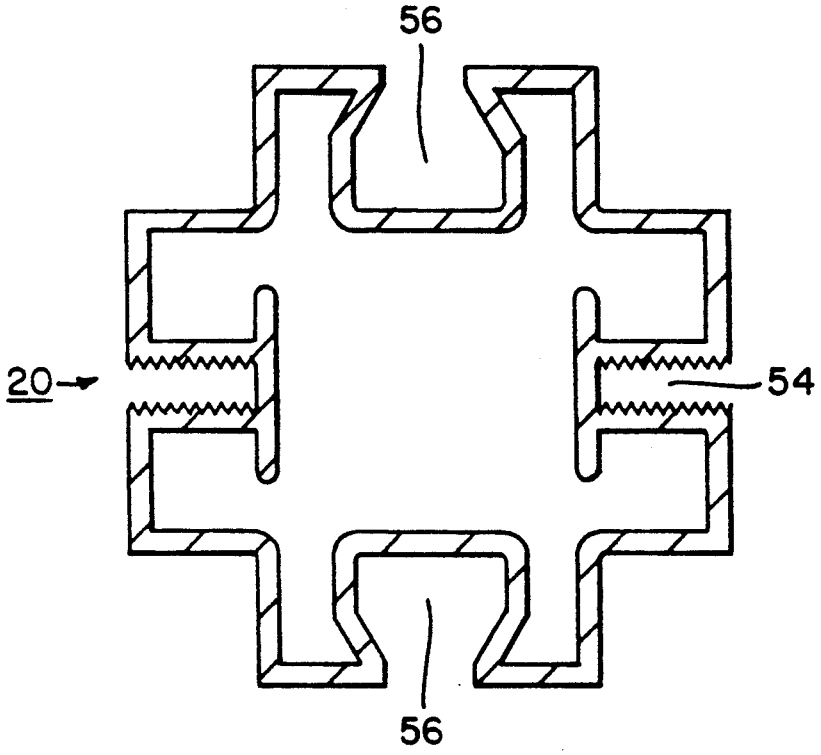
FIG. 7 is a cross-sectional view schematically illustrating one embodiment of the chord and diagonal web members, in accordance with the present invention.

As is schematically illustrated by FIG. 7, the tubular members of the present invention may have an irregular outer surface, rather than one which is strictly rectangular in cross section. In the embodiment shown, the outer surface of the tubular member is further disposed so as to form at least one groove 54 which extends along the length of the tubular member. Groove 54 is sufficiently deep that the sides of the groove may be engaged with external fasteners which are disposed therein. For example, the groove may be engaged by self-tapping screws. Alternatively, as shown in FIG. 7, groove 54 may be configured so that the sides thereof form threads which extend along the length of the groove. The longitudinal axis of the thread pattern then extends into the direction of the depth of the groove. Such an arrangement provides the desirable characteristic that bolts may be screwed into groove 54 at any location along its entire length. In yet another embodiment, the groove may be disposed so that it is narrowest in width at a location near the outer surface of the member and wider at locations nearer the inner surface thereof, in the manner shown in FIG. 7 by groove 56. External apparatus may be connected to groove 56 by a keyway hanger which slides along groove 56 or by wedge bolts which are inserted into the groove and then turned a quarter turn in order to be retained in the groove.

Figure 8:
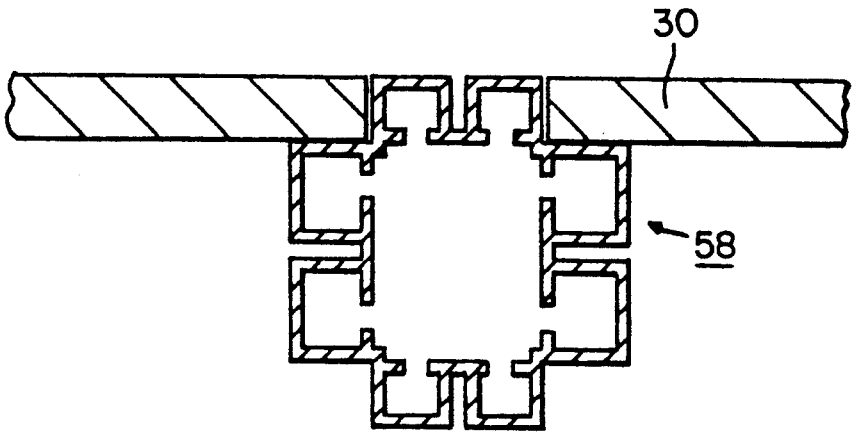
FIG. 8 is a cross-sectional view schematically illustrating one embodiment of a supplementary support member, in accordance with the present invention.
Figure 9:
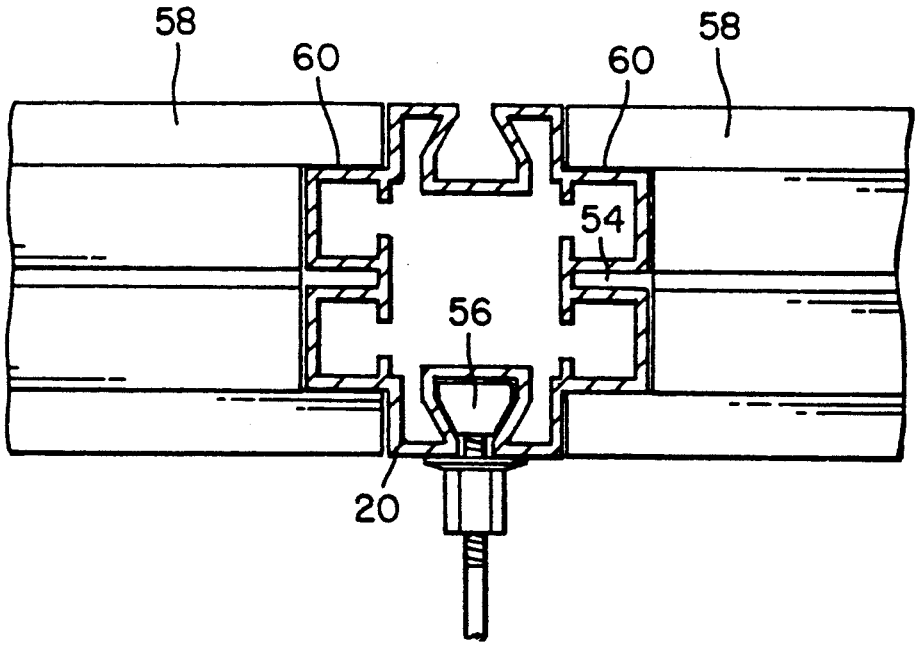
FIG. 9 is an elevational view in partial cross section schematically illustrating the manner in which the outer shape of the supplementary member illustrated in FIG. 8 is complementary to, and fits together with, the outer shape of the chord and diagonal web members of the present invention.

FIG. 8 illustrates one embodiment of a supplementary support member which may be utilized in the present invention. Such members may be disposed in the plane of top chord members 20, and may be attached to top chord members 20 in order to provide support for decking and other coverings 30. Preferably, the outer surface of the support member is disposed in the manner shown in FIG. 8, so that it is complementary in shape to the outer surface of top chord 20. As shown by FIG. 9, such a configuration has the advantage that, when complementary member 58 is placed adjacent to top chord 20 at an orthogonal angle thereoto, the adjacent end of supplementary member 58 fits together with top chord 20 so that it is supported by and engaged with the abutting portion 60 of top chord 20. In this configuration, chords 20 can be selectively fitted with either decking or supplementary support members.

Figure 10:
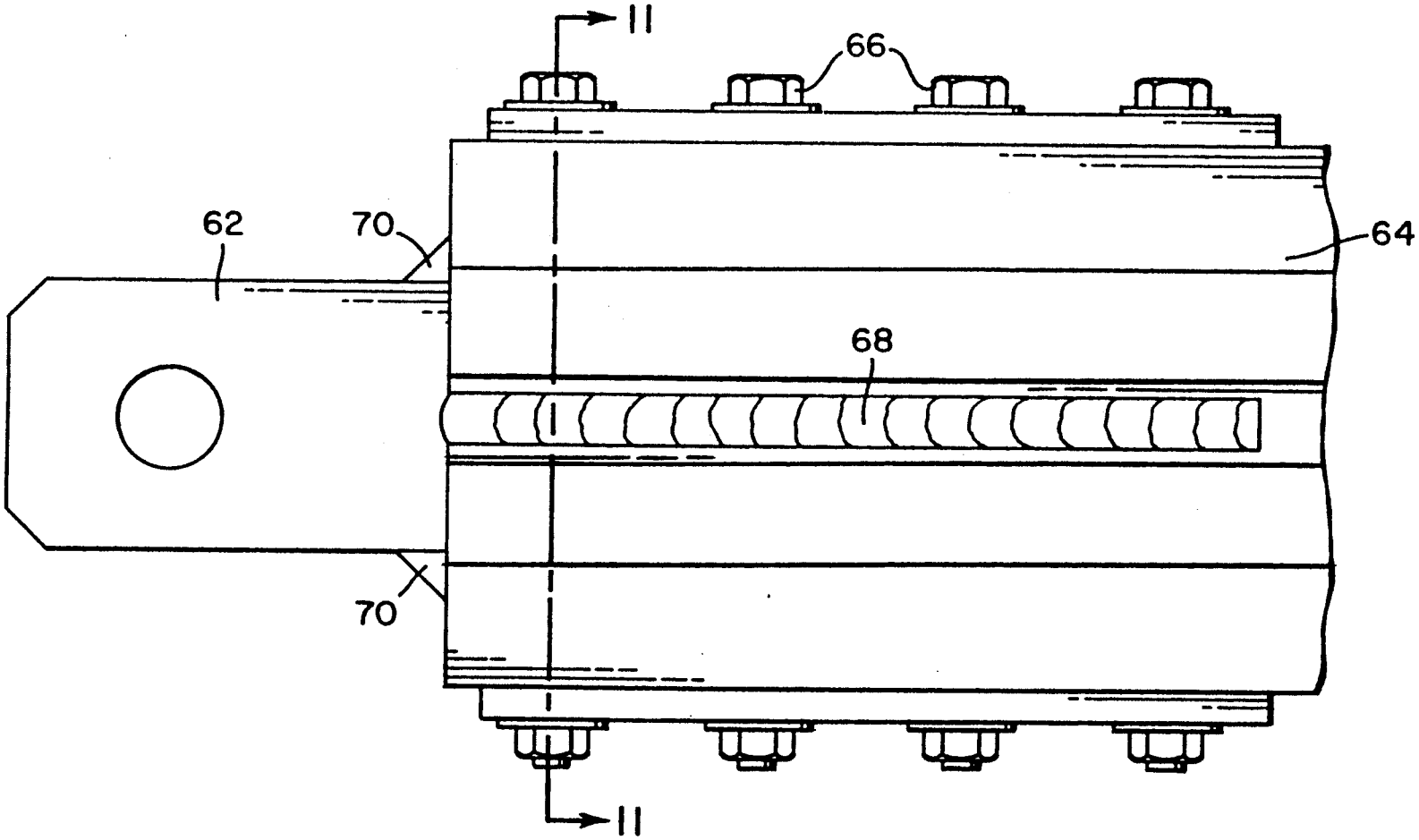
FIG. 10 is a side-elevational view schematically illustrating one embodiment of a very high strength connection between the chord and diagonal web members and the associated node components.
Figure 11:
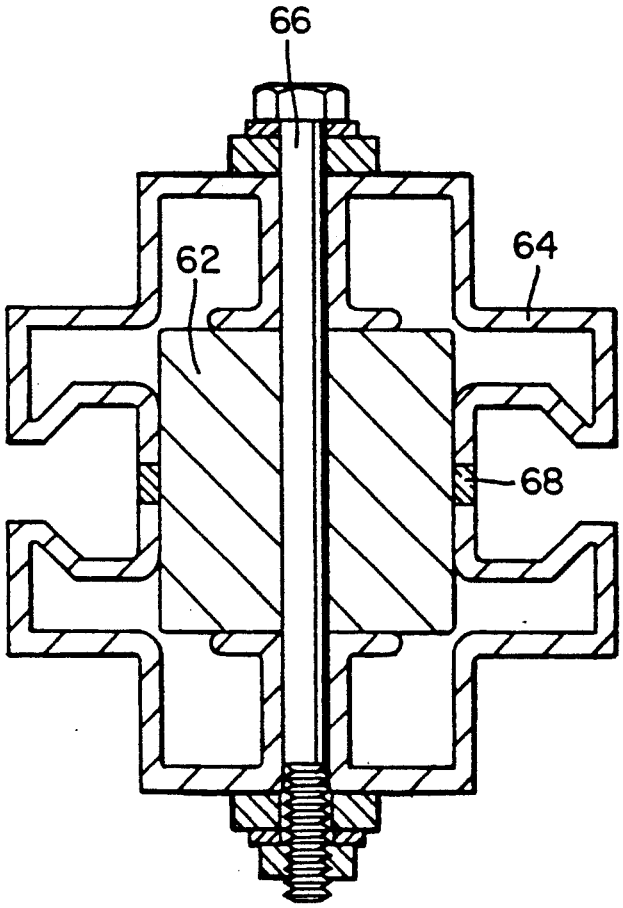
FIG. 11 is a cross-sectional view of the assembly shown in FIG. 10, taken along lines 11—11.

For the type of tubular members illustrated and described hereinabove, it is useful to attach to the ends thereof a portion having reduced cross-sectional area for connection of the tubular members to the associated nodes. The present inventors have found that the arrangement illustrated in FIGS. 10 and 11 provides an extremely high strength connection, while simultaneously providing an efficient transfer of the outside metal area contained in member 64 to the metal area contained in connecting portion 62. The transition in size between members 64 and 62 is accomplished by a plurality of structural web members which extend from the interior surface of member 64 to the outer surface of connection member 62. As illustrated in FIG. 11, connection member 62 is attached to opposing pairs of the web portions of member 64 by fastener 66 which is disposed through the opposing web portions and also through member 62. Fastener 66 provides a force which compresses the web portions of member 64 against the outer surface of member 62. In addition to connector 62 being bolted to tubular member 64 by bolts 66, it may also be welded thereto by slot weld 68. As an additional precaution, portion 62 may be welded to member 64 at locations 70.

The foregoing describes a modular truss frame system which can be used in a variety of applications. A number of frame configurations can be formed from relatively few components. The completed assembly exhibits very high span strength and torsional rigidity.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A modular truss frame system, comprising:

a plurality of interchangeable tubular top chord members;

a plurality of interchangeable tubular diagonal web members;

a plurality of top node connection members which join predetermined ones of said top chord members together in an end-to-end relationship, said top node members being further disposed so as to also join one end of each of said web members to the ends of predetermined ones of said top chord members;

a plurality of bottom node connection members which join together predetermined ones of the ends of said web members which are opposite the ends thereof that are joined to said chord members by said top node members; and means for attaching said top chord members and said web members to said top node member, and said web members to said bottom node members, said attaching means being disposed so that said members are attachable to their respective node members without rotational movement of said members, and so that said web members form truss-like braces for said top chord members, said top node connection member and said attaching means being further configured so that said connected top chord member is substantially restrained from bending movement with respect to said top node connection member, in directions which intersect a plane containing said top chord members, and so that said connected diagonal web member is substantially restrained from bending movement with respect to said top node connection member, in directions which are parallel to a plane containing said top chord members.

2. The system of claim 1 wherein said attaching means comprises openings defined in said node members and corresponding openings defined in the associated ends of said top chord members and said web members, said openings being further disposed so that the openings in said top chord and web members are aligned with the respective openings in said node members when said components are properly positioned with respect to each other, said attaching means further including a fastener disposed through each said set of aligned openings.

3. The system of claim 1 wherein said top chords and said top nodes are further disposed so that, when said top chords are joined together, they form a continuous chord line in a direction parallel to that spanned by the connected top chords.

4. The system of claim 1 wherein said top chords are further disposed so as to form the shape of a series of interconnected squares.

5. The system of claim 1 wherein said web members are further configured with respect to said top chords so as to be symmetrically disposed about a plane which is taken through the center of the particular bottom node which joins together a group of said web members, which plane is perpendicular to the plane containing said top chords.

6. The system of claim 5 wherein said connected top chords, web members, and top and bottom nodes form the shape of a series of interconnected inverted pyramids. are disposed therein.

7. The system of claim 1 further comprising a plurality of supplementary support members which are attachable to said top chord members, for providing additional support members in the plane of said top chord members, at locations between said top chord members.

8. The system of claim 7 wherein the outer surface of said support member is disposed so as to be complementary in shape to the outer surface of said top chord member, so that when said supplementary member is placed against said top chord member at an orthogonal angle thereto, the adjacent end of said supplementary member is supportably engaged with the abutting portion of said top chord member.

9. The system of claim 1 wherein said tubular members each have attached thereto a reduced cross-sectional area port for connection to its associated node member.

10. The system of claim 9 wherein said reduced cross-sectional area portion comprises a rectangularly shaped connection member which is inserted along a portion of its length into the interior portion of said associated tubular member, and wherein said tubular member includes, as an integral portion thereof, a plurality of web members which extend from the interior surface of said tubular member to the outer surface of said connection member, said web members being further disposed so that opposing pairs thereof are located on opposite sides of said connection member, said system further comprising means for attaching said connection member to said web members.

11. The system of claim 10 wherein said means for attaching said connection member to said web members comprises at least one fastener disposed through at least one pair of said opposing web members and also through said connection member, so that said fastener compresses said web members against the outer surf of said connection member.

12. The system of claim 10 wherein at least one pair of said opposing web members are welded to the outer surface of said connection member.

13. The system of claim 1 wherein said top and bottom node members are identical.

14. The system of claim 13 wherein each said node member comprises:

first and second plate members disposed generally parallel to each other, each said plate member having a plurality of connection openings defined therethrough, with the longitudinal axis of each said opening being in a direction which is substantially perpendicular to the plane of said parallel plate members, said openings being further disposed for alignment with corresponding openings in said top and bottom chord members, through which openings a fastening pin may be disposed in order to secure said node to said chord members;

a spacer member disposed between said first and second plate members, with said spacer member being rigidly attached at its opposite ends to said first and second plate members, said plate members being further disposed so as to substantially restrain said connected top chord member from bending movement with respect to said node member, in directions which intersect the plane of said parallel plate members; and a plurality of tab members attached to one of said plate members, on the face of said plate which is opposite the face that is attached to said spacer, said tab members extending generally perpendicularly away from the plane of said plate member, each said tab member having at least one connection opening defined therethrough, with the longitudinal axis of each said opening being in a direction which is substantially parallel to the plane of said plate member, said opening being further disposed for alignment with corresponding openings in said web members, through which openings a fastening pin may be disposed in order to secure said node to said web member, said tab members being further disposed so as to substantially restrain said connected diagonal web member from bending movement with respect to said node member, in directions which are parallel to the plane of said plate member.

15. The system of claim 14 wherein said spacer member comprises a hollow cylinder disposed so that its longitudinal axis is substantially perpendicular to the plane containing said parallel first and second plate members.

16. The system of claim 14 wherein each said tab member has a plurality of said connection openings, with each said opening being located so that, when said diagonal web member is connected to said node using said opening, forces are transmitted through said diagonal member in a direction which intersects the center of said node.

17. The system of claim 14 wherein said first and second plates also have defined therein at least one set of aligned openings for attachment of external apparatus to said node.

18. The system of claim 1 further comprising a plurality of interchangeable tubular bottom chord members which join together predetermined ones of said bottom node members.

19. The system of claim 18 wherein said bottom chords and said bottom nodes are further disposed so that, when said bottom nodes are joined together, said bottom chords form a continuous chord line in a direction parallel to that spanned by the connected bottom chords.

20. The system of claim 18 wherein said top chord members, said bottom chord members, and said web members are identical in cross-sectional shape.

21. The system of claim 20 wherein said cross-sectional shape is generally rectangular.

22. The system of claim 21 wherein the outer surface of each said tubular member is further disposed so as to form at least one groove which extends along the length of said tubular member, said groove being sufficiently deep that the sides thereof are engageable with external fasteners which are disposed therein.

23. The system of claim 22 wherein said at least one groove is further disposed so that the sides thereof form threads which extend along the length of said groove, with the longitudinal axis of said threads extending into the direction of the depth of said groove.

24. The system of claim 22 wherein said groove is further disposed so that it is narrowest at a location near the outer surface of said tubular member and wider at locations nearer the inner surface of said member.

* * * * *